US008197748B2

(12) United States Patent
Lee et al.

(10) Patent No.: US 8,197,748 B2
(45) Date of Patent: Jun. 12, 2012

(54) CORROSION RESISTANT STRUCTURAL ALLOY FOR ELECTROLYTIC REDUCTION EQUIPMENT FOR SPENT NUCLEAR FUEL

(75) Inventors: Jong-Hyeon Lee, Daejeon (KR); Soo-Haeng Cho, Daejeon (KR); Eung-Ho Kim, Daejeon (KR); Seong-Won Park, Daejeon (KR)

(73) Assignee: Korea Atomic Energy Research Institute, Daejeon (KR)

( * ) Notice: Subject to any disclaimer, the term of this patent is extended or adjusted under 35 U.S.C. 154(b) by 440 days.

(21) Appl. No.: 12/338,110

(22) Filed: Dec. 18, 2008

(65) Prior Publication Data

US 2010/0155236 A1 Jun. 24, 2010

(51) Int. Cl.
*C25B 11/04* (2006.01)
*C22C 19/05* (2006.01)

(52) U.S. Cl. ..... 420/447; 204/293

(58) Field of Classification Search ..... 420/448, 420/447; 204/293
See application file for complete search history.

(56) References Cited

U.S. PATENT DOCUMENTS

| | | | | |
|---|---|---|---|---|
| 4,034,142 | A | | 7/1977 | Hecht |
| 4,183,774 | A | | 1/1980 | Balleret |
| 4,231,795 | A | * | 11/1980 | Gibson et al. ..... 420/448 |
| 4,818,486 | A | | 4/1989 | Rothman et al. |

FOREIGN PATENT DOCUMENTS

| | | | |
|---|---|---|---|
| EP | 0 091 279 | * | 10/1983 |
| JP | 05-033090 | * | 2/1993 |
| JP | 2002-180169 | * | 6/2002 |

OTHER PUBLICATIONS

English Abstract and English Machine Translation of Okada et al. (JP 2002-180169) (2002).*

J. Stringer et al., "The High-Temperatuere Oxidation of Nickel-20 wt.% Chromium Alloys Containing Dispersed Oxide Phases", Oxidation of Metals, vol. 5, No. 1, 1972, pp. 11-47.*

English Abstract and English Machine Translation of Sawaragi et al. (JP 05-033090) (1993).*

Soo Haeng Cho et al., Corrosion Behavior of Ni-Based Structural Materials for Electrolytic Reduction in Lithium Molten Salt, Journal of Nuclear Materials, 412, (2011), pp. 157-164.

* cited by examiner

*Primary Examiner* — Jessee R. Roe
(74) *Attorney, Agent, or Firm* — The Nath Law Group

(57) ABSTRACT

Disclosed is a structural alloy with oxidation resistance for electrolytic reduction equipment for treatment of spent nuclear fuel. More particularly, the present invention relates to a structural alloy with oxidation resistance for electrolytic reduction equipment for treatment of spent nuclear fuel wherein Cr, Si, Al, Nb and Ti are added to a Ni-based substrate so as to form an oxide coating film which is stable in a LiCl—$Li_2O$ molten salt and, in addition, a process thereof and use of the same.

2 Claims, 4 Drawing Sheets

CORROSION RESISTANT STRUCTURAL ALLOY FOR ELECTROLYTIC REDUCTION EQUIPMENT FOR SPENT NUCLEAR FUEL

BACKGROUND OF THE INVENTION

1. Field of the Invention

The present invention relates to a corrosion resistant structural alloy for electrolytic reduction equipment for treatment of spent nuclear fuel, more particularly, to a corrosion resistant structural alloy for electrolytic reduction equipment used for treatment of spent nuclear fuel, wherein Cr, Si, Al, Nb and Ti are added to a nickel (Ni) based substrate to form an oxide coating film which is stable in a LiCl—$Li_2O$ molten salt, in addition, a process for formation of the same and use thereof.

2. Description of the Related Art

An electrolytic reduction process of an oxide based spent nuclear fuel generally includes introducing the oxide based spent nuclear fuel into an anode in a LiCl—$Li_2O$ molten salt, applying electricity to reduce $Li_2O$, and then, using the reduced Li to reduce nuclear fuel components. Such a process is very severe upon most of structural metal materials in chemical aspects due to strong corrosive properties of $Li_2O$ and oxygen generated at a cathode. Especially, fuel components react with a structural material during a reduction process so as to form a liquid phase, thus accelerating corrosion. Accordingly, a reactor for electrolytic reduction and at least one structural material used therein must have durability in a LiCl molten salt atmosphere including oxygen, a transuranic (TRU) component and $Li_2O$ at 650□. However, commercially available alloys lack enough corrosion resistance to endure the above described condition and cannot ensure stability in operating for a long period of time. For requirement of high-temperature corrosion resistance, Ni-based alloys are mainly used. For an alloy requiring corrosion resistance in specific conditions, the alloy may have a constitutional composition varied according to uses thereof. U.S. Pat. No. 4,034,142 (Jul. 5, 1977), entitled "Superalloy base having a coating containing silicon for corrosion/oxidation protection," describes an alloy which was developed for gas turbine engines, which has a large content of Co and was also used as a coating material. Accordingly, the above alloy is not of course used in a molten salt atmosphere. U.S. Pat. No. 4,818,486 (Apr. 4, 1989), entitled "Low thermal expansion superalloy," describes an Ni-based alloy including 8 wt. % of Cr, 25 wt. % of Mo, 0.003 wt. % of B, 1 wt. % of Fe, 0.5 wt. % of Mn and 0.4 wt. % of Si, which was prepared in order to develop a base material for a plasma spray type ceramic coating. However, the corrosion resistance of the above alloy in a molten salt atmosphere was not considered. U.S. Pat. No. 4,183,774 (Jan. 15, 1980), entitled "High-endurance superalloy for use in particular in the nuclear industry," discloses an Fe, Ni or Co based alloy including 0.2 to 1.9 wt. % of C, 18 to 32 wt. % of Cr, 1.5 to 8 wt. % of W, 15 to 40 wt. % of Ni, 6 to 12 wt. % of Mo, 0 to 3 wt. % of Nb—Ta, 0.2 wt. % of Si, 0 to 3 wt. % of Mn, 0 to 3 wt. % of Zr, 0 to 3 wt. % of V, 0 to 0.9 wt. % of B and less than 0.3 wt. % of Co, however, corrosion resistance of the patented alloy in an electrolytic reduction molten salt atmosphere was not considered in view of use thereof. This alloy has a composition different from that of the present invention. Accordingly, a novel alloy with excellent corrosion resistance in a LiCl—$Li_2O$ molten salt system is still not yet reported.

A number of researches and studies for treatments of oxide spent nuclear fuels have been actively conducted in Korea and other advanced countries including the United States, Japan, and so forth. Especially, in order to treat the oxide spent nuclear fuel, investigations into metallization of the fuel in a LiCl—$Li_2O$ molten salt atmosphere via electrolytic reduction are underway. Such spent nuclear fuel after metallization can be directly processed into a metal nuclear fuel for a high speed furnace through a molten salt electrolytic refining process, therefore, may be considered as an effective technical strategy for treatment of an oxide spent nuclear fuel. However, the LiCl—$Li_2O$ molten salt which is an electrolytic reduction electrolyte has strong corrosive properties to conventional structural materials, therefore, makes it difficult to select an appropriate structural material for electrolytic reduction equipment with high reliability.

Recently developed corrosion resistant alloys commercially available in the art are in general alloys designed to attain favorable corrosion resistance against a high temperature oxidative gas and/or an oxidative aqueous solution. However, an improved alloy with corrosion resistance at 650□ in a LiCl—$Li_2O$ molten salt atmosphere which is a condition for electrolytic reduction of spent nuclear fuel is still not developed. From experimental results for the commercial alloys, it was determined that all commercial alloys have corrosion rate of more than a reference level of 0.5 mm/yr. Among such commercial alloys, Inconel 713 LC with the most excellent corrosion resistance exhibited a corrosion rate of at least 1.5 mm/yr measured under electrolytic reduction conditions, that is, in a LiCl-3 wt. % $Li_2O$ molten salt atmosphere. Therefore, it is difficult to use the above alloy in industrial applications.

Accordingly, there is still a need for development of a novel material with more reduced corrosion rate sufficient to use in hot cell working environments requiring high reliability.

SUMMARY OF THE INVENTION

The present inventors have undertaken extensive studies and investigation to select proper alloy elements for improving corrosion resistance in a LiCl—$Li_2O$ atmosphere among the conventional commercial alloys, to theoretically calculate an alloying amount of Si, which is not typically used in the commercial alloys, and to combine various alloys. As a result, it was found that a structural alloy with oxidation resistance for electrolytic reduction equipment for treatment of spent nuclear fuel, may be prepared by adding Cr, Si, Al, Nb and Ti to a Ni-based substrate to form an oxide coating film which is stable in a LiCl—$Li_2O$ molten salt, thus accomplishing the present invention.

Accordingly, the present invention has been proposed to solve conventional problems described above and an object of the present invention is to provide a structural alloy with oxidation resistance for electrolytic reduction equipment for treatment of spent nuclear fuel, which includes nickel (Ni) as a main ingredient and at least one alloy element in combination thereof, so that the prepared alloy may exhibit remarkably improved corrosion resistance in a LiCl—$Li_2O$ molten salt at 650□ or less which is not given to any conventional commercial alloy and, in addition, may be stably used for a long time under electrolytic reduction conditions for an oxide spent nuclear fuel.

Another object of the present invention is to provide a process for preparation of a structural alloy with oxidation resistance for electrolytic reduction equipment for treatment of spent nuclear fuel, comprising the steps of: calculating a theoretical amount of an alloy element solid-soluble in a Ni-based substrate to design an alloy; selecting a particular alloy element capable of maintaining chemical stability in an oxidative molten salt atmosphere; and mixing at least one alloy element with the Ni-based substrate and vacuum casting the mixture so as to produce an alloy with superior corrosion resistance in an electrolytic reduction atmosphere for an oxide spent nuclear fuel.

A still further object of the present invention is to provide use of the oxidation resistant structural alloy for electrolytic reduction equipment for treatment of spent nuclear fuel in specific applications as a structural material for an electrode and/or a crucible, etc.

In order to achieve the above objects of the present invention, there is provided a structural alloy with oxidation resistance for electrolytic reduction equipment for treatment of spent nuclear fuel, wherein the alloy is prepared by adding Cr, Si, Al, Nb and Ti to a Ni-based substrate to form an oxide coating film which is stable in a LiCl—$Li_2O$ molten salt.

The present invention also provides use of the structural alloy prepared as described above as a structural material for an electrode and/or a crucible in a process for electrolytic reduction of an oxide spent nuclear fuel.

The present invention provides use of the structural alloy prepared as described above as a structural material for an electrode and/or a crucible in a process for reduction of oxide materials.

Additionally, the present invention provides a process for preparation of a structural alloy with oxidation resistance for electrolytic reduction equipment for treatment of spent nuclear fuel, comprising the steps of: calculating a theoretical amount of an alloy element solid-soluble in a Ni-based substrate to design an alloy; mixing at least one alloy element, which is capable of maintaining chemical stability in an oxidative molten salt atmosphere, with the Ni-based substrate; and vacuum casting the mixture so as to produce an alloy with superior corrosion resistance in an electrolytic reduction atmosphere for an oxide spent nuclear fuel.

As is apparent from the above description, a Ni-based alloy with oxidation resistance developed by the present invention has various advantages in which the alloy noticeably improves corrosion resistance of a structural material which in turn enhances reliability of processing equipment, reduces operation shutdown term for maintenance and generation of waste, and improves electrolytic reduction efficiency, thereby further promoting commercial use of the alloy. In addition to treatment of the spent nuclear fuel, the inventive alloy may also be used as a corrosion resistant structural material for reduction of industrially common materials such as $Ta_2O_5$, $TiO_2$, $ZrO_2$, and the like, considerably facilitating industrial development of related technologies.

BRIEF DESCRIPTION OF THE DRAWINGS

These and other objects, features, aspects, and advantages of the present invention will be more fully described in the following detailed description of preferred embodiments and examples, taken in conjunction with the accompanying drawings. In the drawings.

DETAILED DESCRIPTION OF THE INVENTION

Figure 1:
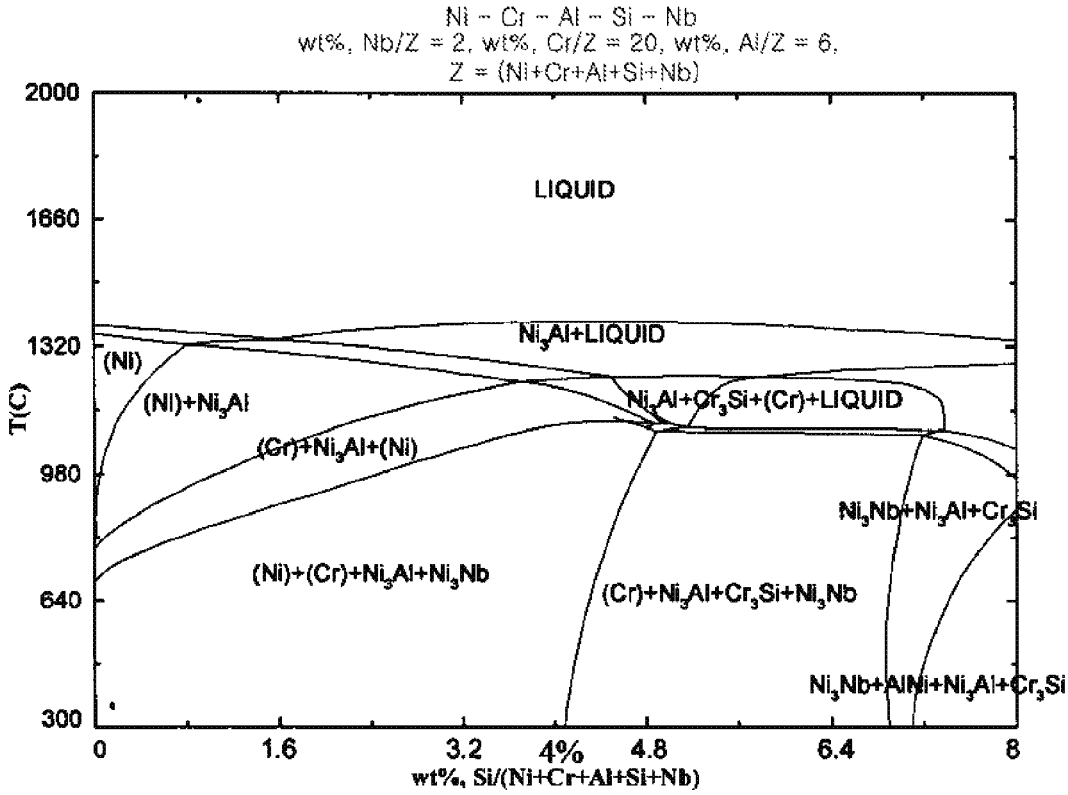
FIG. 1 illustrates a phase diagram of a pseudo-binary Ni—Cr—Al—Si—Nb alloy (20 wt. % Cr) calculated by FACTSage.

According to the present invention, a structural alloy with oxidation resistance for electrolytic reduction equipment for treatment of spent nuclear fuel is prepared by adding Cr, Si, Al, Nb and Ti to a Ni-based substrate to form an oxide coating film which is stable in a LiCl—$Li_2O$ molten salt.

The alloy element used herein may include 0.1 wt. % or less of each of Fe, Co and Mo. More preferably, the alloy element may have a constitutional composition of: 0.01 to 0.1 wt. % of each of Fe, Co and Mo; 0.5 to 20 wt. % of Cr; 0.5 to 5 wt. % of Si; 1 to 7 wt. % of Al; 0.5 to 2 wt. % of Nb; 0.1 to 0.5 wt. % of Ti; and the balance being Ni.

The above alloy may be used as a structural material for an electrode and/or a crucible in a process for electrolytic reduction of an oxide spent nuclear fuel.

The alloy may also be used as a structural material for an electrode and/or a crucible in a process for reduction of industrial materials such as $Ta_2O_5$, $TiO_2$, $ZrO_2$ or other oxides.

The present invention provides a process for preparation of a structural alloy with oxidation resistance for electrolytic reduction equipment for treatment of spent nuclear fuel.

More particularly, according to the present invention, the process for preparation of a structural alloy with oxidation resistance for electrolytic reduction equipment for treatment of spent nuclear fuel comprises: designing an alloy element solid-soluble in a Ni-based substrate; mixing at least one alloy element, which is capable of maintaining chemical stability in an oxidative molten salt atmosphere, with the Ni-based substrate; and vacuum casting the mixture so as to produce an alloy with superior corrosion resistance in an electrolytic reduction atmosphere for an oxide spent nuclear fuel.

As to the preparation process described above, the alloy element solid-soluble in the Ni-based substrate may include, for example, Cr, Si, Al, Nb and Ti.

The alloy element used in the above preparation process may include 0.1 wt. % or less of each of Fe, Co and Mo. More preferably, the alloy element may have a constitutional composition of: 0.01 to 0.1 wt. % of each of Fe, Co and Mo; 0.5 to 20 wt. % of Cr; 0.5 to 5 wt. % of Si; 1 to 7 wt. % of Al; 0.5 to 2 wt. % of Nb; 0.1 to 0.5 wt. % of Ti; and the balance being Ni.

The following description will be given of preferred embodiments of the present invention.

The electrolytic reduction process for an oxide spent nuclear fuel is an electro-chemical treatment process which includes introduction of uranium oxide to an anode in a LiCl-3 wt. % $Li_2O$ molten salt at 650□ and reduction of Li so as to indirectly reduce the uranium oxide. During this process, oxygen ions are discharged from a cathode. Oxygen generated at high temperatures and $Li_2O$ contained in the molten salt generally exhibit strong corrosive properties to structural materials, causing a significant problem in selecting the structural material for treatment of spent nuclear fuel requiring high reliability. It was determined that stainless steel and some of Ni-based superalloys as representative examples of the conventional structural materials exhibit relatively excellent corrosion resistance. However, since these materials show insufficient characteristics for long term operation, a novel structural material for equipment on a scale of mass production is required. Especially, most of the structural materials contain U and Pu and have a low eutectic point, while some materials such as Al, Ni, Cr and Fe react with fuel ingredients at a temperature of less than 650□, which is the temperature for electrolytic reduction. Therefore, with progress of the reduction, a liquid phase is formed on the structural material and may accelerate corrosion of the structural material. Accordingly, direct contact between a metal material and a fuel ingredient must be prevented and a predetermined alloying composition at which a desired oxide coating film may be formed under electrolytic reduction conditions is required. As for a passive oxide coating film formed on a corrosion resistant material, thin film peeling owing to a difference of thermal expansion coefficients between an oxide layer and a metal substrate of the material as well as chemical stability in a corrosive atmosphere should be considered. In particular, as for a molten salt system described in the present invention, if the molten salt penetrates into a (structural) material through cracks and/or pores of an oxide coating film of a material generated by a difference in thermal expansion coefficients between an oxide layer and a metal substrate of the material, corrosion resistance of the structural material markedly decreases. Therefore, the thermal expansion coefficient of the metal substrate should be considered.

An ultimate purpose of the present invention is to develop an alloy exhibiting excellent corrosion resistance in a specific medium such as a LiCl—$Li_2O$ molten salt for electrolytic reduction in such a way that a favorable combination of individual alloy elements capable of forming a solid solution together with Ni is prepared while excluding undesirable elements except the above alloy elements.

More particularly, Mo and Ni contained in a Ni-based alloy forms a solid solution and can improve strength of the alloy. However, they show a behavior of being concentrated at an interface of an oxide in a LiCl—$Li_2O$ molten salt atmosphere and do not have a substantial role in improvement of corrosion resistance. Accordingly, the above two elements were excluded from the present invention.

Although Fe and Co contained in a Ni-based alloy can also enhance solid soluble properties, these elements prevent formation of an oxide coating film which is stable in a LiCl—$Li_2O$ molten salt atmosphere, thus being excluded from an alloy system according to the present invention. Contrary to these cases, Al and Nb are each elements to be combined with Ni to form an intermetallic compound which in turn may enhance strength of the alloy. Al, especially, forms a stable passivation coating film in order to inhibit internal oxidation, and therefore, is considered as an essential element added to the Ni-based alloy in a LiCl—$Li_2O$ molten salt system.

Cr exhibits extremely high solid solubility to Ni and is very effectively used to improve solid solubility of a Ni-based alloy. Since a Cr oxide is formed on a surface of the alloy in a LiCl—$Li_2O$ molten salt atmosphere, oxidation thereof is significantly reduced.

Si is an important alloy element having excellent solid solubility to Ni while showing a very low thermal expansion coefficient so as to advantageously prevent peeling of an oxide coating film from the alloy and to form a stable passivation coating film on a surface of the alloy, thus inhibiting oxidation thereof.

Figure 2:
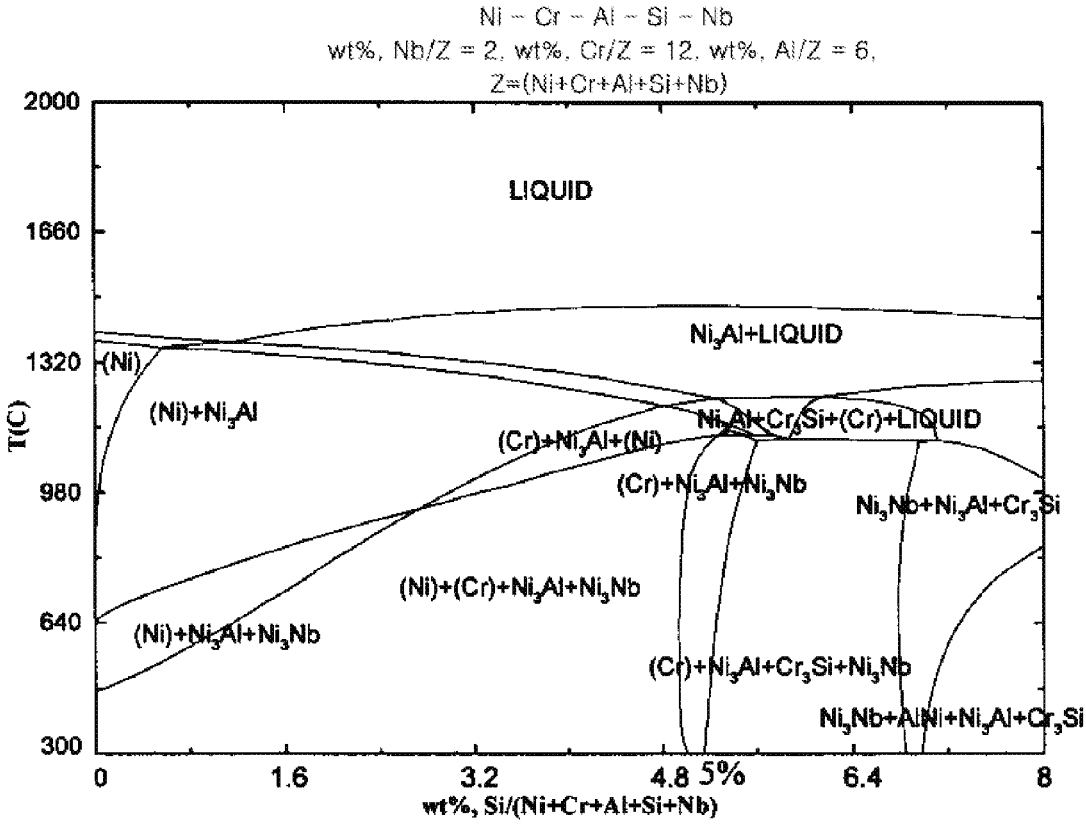
FIG. 2 illustrates a phase diagram of a pseudo-binary Ni—Cr—Al—Si—Nb alloy (12 wt. % Cr) calculated by FACTSage.

In general, a phase equilibrium for a binary alloy is well known in existing published documents. However, phase diagrams of ternary or more multi-component based alloys are very limited except in a few cases thereof. Especially, for a pentad alloy considered in the present invention, information for the alloy is obtained only by theoretical calculation, owing to complexity of the alloy system. In order to obtain the information, phase diagrams for Ni—Cr—Al—Si—Nb alloy systems were prepared by the commercial FACTSage thermodynamic database used in calculations as shown in FIGS. 1 and 2.

First of all, if a Ni-based alloy containing 2 wt. % of Nb, 20 wt. % of Cr and 6 wt. % of Al includes an increased amount of Si, Si forms a solid solution on Ni until 4 wt. % thereof. Also, if a content of Si exceeds the above value, an intermetallic compound such as $Cr_3Si$ may be generated. When the Si containing intermetallic compound is generated, an alloy material shows increased brittleness and sensibility to corrosion, expecting a decrease in corrosion resistance. Therefore, an amount of Si to be added must be restricted to not more than 4 wt. %. Alternatively, if a content of Cr is maintained at 12 wt. %, as illustrated in FIG. 2, it can be seen that the solubility of Si in Ni-based alloy is elevated up to 5 wt. %.

Based on the constitutional composition described above, a Ni-based alloy may be produced by vacuum dissolving and casting Ni and other alloy elements. Such produced Ni-based alloy can be utilized in a process for reduction of industrially common materials such as $Ta_2O_5$, $TiO_2$, $ZrO_2$, etc., as well as an electrolytic reduction process of spent nuclear fuel.

Briefly, the technical concept for developing a Ni-based alloy proposed by the present invention includes: (1) an alloy with excellent corrosion resistance in a LiCl—$Li_2O$ molten salt atmosphere; (2) a particular composition of alloy elements capable of forming an oxide coating film which is stable in a LiCl—$Li_2O$ molten salt, wherein contents of Cr, Si, Al, Nb and Ti except Fe, Co and Mo among the alloy elements are controlled; (3) the composition of alloy elements measured in the present invention may include 12 wt. % or less of Cr, 5 wt. % or less of Si, 6 wt. % or less of Al, 2 wt. % or less of Nb, and 0.5 wt. % or less of Ti, while maximally reducing contents of Fe, Co and Mo to 0.1, 0.06 and 0.01 wt. %, respectively; (4) the produced Ni-based alloy may be utilized in reduction of industrially common materials such as $Ta_2O_5$, $TiO_2$, $ZrO_2$, etc., as well as an electrolytic reduction process of spent nuclear fuel.

Hereinafter, the present invention will be described in detail in the following example with reference to the accompanying drawings, which is given for illustrative purposes only and should not be construed as limiting the spirit and scope of the invention.

EXAMPLE

A novel alloy was fabricated according to the above description. More particularly, four Ni-based alloy ingots having predetermined compositions as listed in TABLE 1 were produced. However, Fe, Co and Mo as alloy elements commonly added to a conventional Ni-based super alloy were omitted in designing the present inventive alloy, since these elements exhibit significant corrosive properties in a LiCl—$Li_2O$ molten salt atmosphere.

TABLE 1

| | Composition of Alloy | | | | | | | | | | | | | | | |
|---|---|---|---|---|---|---|---|---|---|---|---|---|---|---|---|---|
| Alloy | Ni | Cr | Fe | Co | C | Si | Mn | P | S | Al | Ti | Nb | Ta | Mo * | Zr | Y |
| N-1 | Bal | 12.1 | 0.11 | 0.064 | 0.061 | 1.9 | <0.02 | <0.005 | <0.002 | 5.8 | 0.5 | 2.0 | <0.003 | — | — | — |
| N-2 | Bal | 12.2 | 0.15 | 0.06 | 0.04 | 4.9 | <0.02 | <0.005 | <0.002 | 6.3 | 0.5 | 2.1 | — | — | — | — |
| N-3 | Bal | 20.2 | 0.12 | 0.05 | 0.036 | 4.5 | <0.02 | <0.02 | <0.02 | 6.3 | 0.51 | 2.0 | <0.003 | — | — | — |
| N-4 | Bal | 12.1 | 0.11 | 0.065 | 0.06 | 2.0 | <0.02 | <0.005 | <0.002 | 5.8 | 0.50 | 2 | <0.003 | 0 | 0.15 | <0.05 |

A process for production of an alloy is conducted as follows: 50 kg of a raw material containing individual elements with corresponding compositions was dissolved with heat at 1700□ in an Ar atmosphere and poured into a preheated mold so as to produce an alloy. On a top of the mold, a hot top was placed in order to prevent contraction holes from being formed in a final product during solidification. A corrosion experiment was conducted as follows: LiCl-3% $Li_2O$ as a starting material of a molten salt was placed in a MgO test crucible and heated in an Ar atmosphere. Following that, the treated material was subjected to heating while flowing an Ar gas at 300□ for 3 hours in order to remove any buildup of moisture. Subsequently, heating the treated material to 650□, a composite molten salt was produced. A test specimen was firstly placed in a furnace which was then heated to a temperature sufficient to form a corrosive environment. Next, after the heated specimen was immersed in a molten salt, a corrosion experiment was performed while feeding a gas mixture to the molten salt through an alumina tube (with a diameter of 6Φ). The temperature sufficient to form a corrosive environment was defined to be 650□ which is a temperature at which an electrolytic reduction process is carried out. The corrosion experiment was conducted at a flow rate of 2 mL/min for 1 to 9 days in an Ar-10% $O_2$ mixed gas atmosphere. After the reaction period of time was up, the specimen was isolated from the molten salt and cooled in the furnace under the Ar atmosphere, followed by sonication cleaning the specimen in distilled water to remove the molten salt. After the purified specimen was dried in a drying furnace for 24 hours or more, weight change of the specimen was measured. The specimen was subjected to analysis of corrosion products and observation of microfine structure of the specimen by XRD (X-ray diffractometer, Rigaku, DMAX/1200), SEM (scanning electron microscope, Jeol, JSM-6300) and EDS (energy dispersive X-ray spectroscope, Jeol, JSM-6300).

Figure 3:
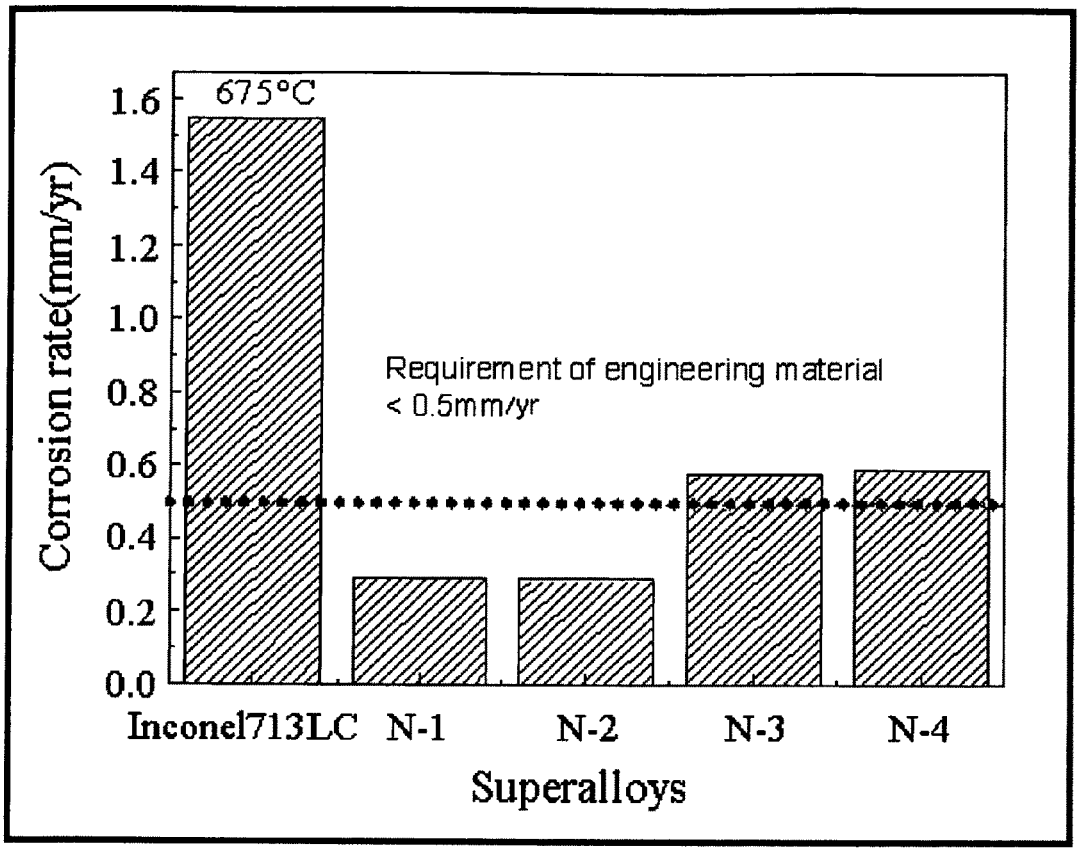
FIG. 3 contains graphs illustrating corrosion rates of designed alloys at an experimental temperature of 650□.

As shown in FIG. 3 which are corrosion rate results measured by a series of corrosion experiments, the present invention produced an alloy with remarkably improved corrosion resistance, compared to Inconel 713 LC as one of existing commercial Ni-based alloys. More particularly, it was identified that the inventive alloy exhibits a corrosion rate of about 0.3 mm/yr lower than an industrially required value, that is, 0.5 mm/yr. As a result, the inventive alloy showed a corrosion resistance 5 times (500%) less than that of the commercial Inconel 713LC.

Figure 4:
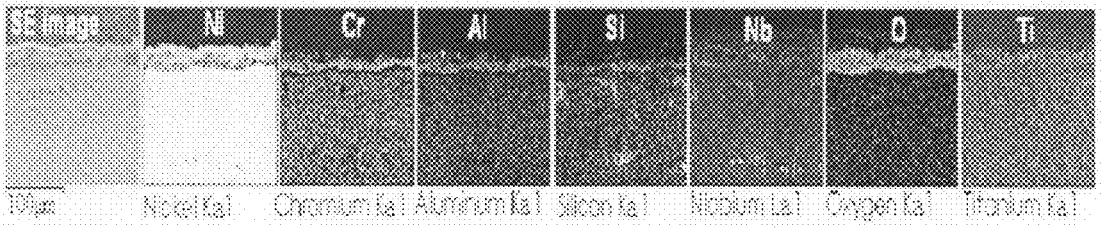
FIG. 4 shows results obtained by observing the surface of a N-2 alloy specimen through SEM-EDX analysis after performing a corrosion experiment therewith.

As described above, the reason behind excellent corrosion resistance of each of N-1 and N-2 alloys was presumed to be that an oxide coating film comprising separate elements was formed in a LiCl—$Li_2O$ molten salt as shown in FIG. 4. On the other hand, for N-3 alloy having a relatively high corrosion rate, it was observed that a distribution of elements is irregular due to high content of Cr and, in addition, a Si containing oxide is not formed on a surface of the alloy.

Consequently, an alloy of the present invention forms an oxide coating film which is stable in a LiCl—$Li_2O$ molten salt atmosphere on a surface of an alloy material by self-alloy ingredients at 650□, in which commercial alloy materials do not have oxidation resistance, thus maintaining stability in an electrolytic reduction atmosphere for a long period of time. Therefore, the present invention may considerably contribute to development of improved electrolytic reduction equipment on a mass production scale. In addition, the produced Ni-based alloy may be utilized as a corrosion resistant structural material in a process for reduction of industrially common materials such as $Ta_2O_5$, $TiO_2$, $ZrO_2$, etc., as well as an electrolytic reduction process of spent nuclear fuel. Accordingly, the present invention may also remarkably contribute to industrial applications of the related technologies.

What is claimed is:

1. A structural alloy with oxidation resistance for an electrolytic reduction equipment for treatment of spent nuclear fuel, wherein the alloy consists essentially of 0.04 to 0.061 wt. % of C; 0.1 wt. % or less of Fe; 0.1 wt. % or less of Co; 12 to 12.2 wt. % of Cr; 0.5 to 5 wt. % of Si; 5.8 to 6 wt. % of Al; 2.0 to 2.1 wt. % of Nb; 0.1 to 0.5 wt. % of Ti; and the balance being Ni, and wherein the alloy forms an oxide coating film which is stable in a LiCl—$Li_2O$ molten salt.

2. The structural alloy according to claim 1, wherein the alloy is used for a structural material for an electrode and/or a crucible in a process for the electrolytic reduction of an oxide spent nuclear fuel.

* * * * *